US011718940B2

(12) United States Patent
Sprenger et al.

(10) Patent No.: US 11,718,940 B2
(45) Date of Patent: Aug. 8, 2023

(54) EMBROIDERY SYSTEM AND EMBROIDERY FRAME ASSEMBLY

(71) Applicant: BERNINA International AG, Steckborn (CH)

(72) Inventors: Levin Sprenger, Hüttwilen (CH); Anna-Marie Babak, Mammern (CH); Patrick R. Morin, Brentwood, TN (US)

(73) Assignee: Bernina International AG, Steckborn (CH)

( * ) Notice: Subject to any disclaimer, the term of this patent is extended or adjusted under 35 U.S.C. 154(b) by 61 days.

(21) Appl. No.: 17/370,073

(22) Filed: Jul. 8, 2021

(65) Prior Publication Data

US 2022/0290348 A1 Sep. 15, 2022

(30) Foreign Application Priority Data

Mar. 11, 2021 (CH) ..... 00267/21

(51) Int. Cl.
*D05C 9/04* (2006.01)

(52) U.S. Cl.
CPC ..... *D05C 9/04* (2013.01)

(58) Field of Classification Search
CPC ... D05C 9/04; D05C 9/10; D05C 1/02; D05C 1/04; D05B 39/00
See application file for complete search history.

(56) References Cited

U.S. PATENT DOCUMENTS 6,298,800 B1 10/2001 Gala
6,679,190 B1 * 1/2004 French ..... D05C 9/04 112/103
2002/0195034 A1 * 12/2002 Stucki ..... D05B 21/00 112/102.5
2005/0072346 A1 4/2005 Shoji
2006/0060116 A1 * 3/2006 Hagino ..... D05C 9/04 112/103
2007/0101917 A1 * 5/2007 Konig ..... D05C 9/04 112/470.18

FOREIGN PATENT DOCUMENTS

EP 0877112 11/1998
JP 10195751 A * 7/1998
JP H10195751 7/1998

OTHER PUBLICATIONS

English translation of JPH10195751, obtained via espacenet.com (last visited Nov. 2, 2022). (Year: 2022).*

* cited by examiner

*Primary Examiner* — Alissa L Hoey
*Assistant Examiner* — Patrick J. Lynch
(74) *Attorney, Agent, or Firm* — Volpe Koenig

(57) ABSTRACT

An embroidery system including an embroidery frame assembly having an inner first frame (51) and an outer second frame (53), a portion of a planar formation to be processed being able to be clamped therebetween. The first frame (51) is connected by a bridge (61) to a radially outer secondary connector (57), and a connecting portion (63) of this bridge (61) bridges the second frame (53) when the latter is connected to the first frame (51). When combined with an embroidery module connected to a free arm sewing machine, the embroidery frame assembly enables in a simple manner the embroidering of pouch-type and tubular planar formations.

14 Claims, 4 Drawing Sheets

EMBROIDERY SYSTEM AND EMBROIDERY FRAME ASSEMBLY

INCORPORATION BY REFERENCE

The following documents are incorporated herein by reference as if fully set forth: Swiss Patent Application No. 00267/21, filed Mar. 11, 2021.

TECHNICAL FIELD

The subject matter of the invention relates to an embroidery system comprising a free arm sewing machine, an embroidery module and an embroidery frame, and to an embroidery frame assembly having one or more of the features disclosed herein.

BACKGROUND

Free arm sewing machines comprise a machine stand which is typically anchored to a base plate, and a lower arm protruding laterally from said machine stand. When such free arm sewing machines stand on a worktop such as a table, for example, the lower arm is free, or disposed so as to be spaced apart from the worktop and optionally from the base plate. Using such free arm sewing machines, henceforth also referred so as sewing machines for short, single-layer or multi-layer planar formations can also be processed even when they are configured in a tubular manner or as pouches. To this end, the tube or pouch is respectively pushed over the free end region of the lower arm. A space for receiving a bobbin capsule having a bobbin onto which the lower thread is wound is situated below a needle plate in this end region of the lower arm. A machine head having a needle bar which can be moved up and down in a reciprocating manner is disposed in the end region of an upper arm above and at a distance from the needle plate. The needle bar is configured for receiving the shank of a sewing needle, or for generally holding a tool with which the planar formation is to be processed.

It is known for such sewing machines to be upgraded with an embroidery module which can preferably be releasably fastened to the sewing machine. Embroidery modules comprise a primary connecting means for releasably fastening a secondary connecting means disposed on an embroidery frame. When the embroidery module is connected to the sewing machine the primary connecting means can be moved in two different directions parallel to the needle plate. The primary connecting means is mounted on a first support so as to be displaceable transversely to the longitudinal direction of the lower arm, for example, and the first support is typically mounted orthogonally thereto on a second support so as to be displaceable in the longitudinal direction of the lower arm. The second support is preferably releasably connected to the sewing machine. Alternatively, the primary connecting means can be mounted on the first support so as to be displaceable in the longitudinal direction of the lower arm, for example, and the first support can be mounted orthogonally thereto on the second support so as to be displaceable transversely to the longitudinal direction of the lower arm. The embroidery module comprises electric motors as driving means for moving and positioning the primary connecting means and the first support, for example. The controller of the sewing machine controls the actuation of the driving means. In order for an embroidery pattern to be generated, the drives of the needle bar and of the embroidery module are conjointly actuated in a coordinated manner according to stored specifications for the respective embroidery pattern.

A portion of a planar formation to be processed is clamped, for example by a clamping device, between a first frame that bears on the upper side of the planar formation and a second frame of an embroidery frame that bears on the lower side of the planar formation. The circumferential length of the first frame is typically somewhat smaller than that of the second frame. Once a portion of the planar formation to be processed is being clamped between the two frames, the lower periphery of the first frame defines the position of the upper side of the portion of the planar formation to be processed.

An embroidery system which comprises an embroidery module which can be fastened to the end side in the case of the free end of the lower arm, or can be fastened in relation to the stand on a free arm sewing machine, is known from EP1783258. A first support here is mounted on a second support so as to be displaceable in the direction of the lower arm. The second support at the end side is connected to the sewing machine. This second support in the region of the free end of the lower arm comprises a recess. A void between the lower arm and the second support enables a tubular planar formation to be pushed over the lower arm even when the embroidery module is docked to the sewing machine.

A primary embroidery frame adapter is mounted on the first support so as to be displaceable transversely to the longitudinal direction of the lower arm. The primary embroidery frame adapter as a primary connecting means comprises a plate which protrudes in the direction of the lower arm and has bores for releasably fastening an embroidery frame. The embroidery frame comprises a closed inner frame and a divided outer frame having a clamping device for clamping the material to be sewn. The outer frame comprises a portion having a secondary connecting means for releasably fastening the embroidery frame on the primary embroidery frame adapter.

When a portion of a tubular material to be sewn is to be embroidered, that part of this material to be sewn that is not clamped has to be pushed over the lower arm of the sewing machine in the direction of the machine stand. In order for the embroidery frame to be able to be connected to the primary embroidery frame adapter, the tubular material to be sewn at the end opposite the lower arm has to have a sufficiently large opening for passing through the secondary connecting means. The tubular planar formation if at all must only slightly overlap the embroidery frame on that side with the secondary connecting element because there is almost no storage space for receiving a portion of the planar formation that protrudes beyond the embroidery frame between the embroidery frame and the neighboring support of the primary connecting element.

The possibilities for embroidering tubular material to be sewn are accordingly very limited. The same applies most particularly when the tubular material to be sewn is long and/or tight with a comparatively small circumference and/or has only a small opening on one side.

Pouch-type planar formations having an opening only on one side cannot be processed by such an embroidery system.

SUMMARY

It is therefore an object of the present invention to achieve an embroidery system and an embroidery frame for easily embroidering tubular or pouch-type planar formations with a free arm sewing machine.

This object is achieved by an embroidery system having one or more of the features disclosed herein and by an embroidery frame assembly also having one or more of the features disclosed herein.

In the embroidery system according to the invention, the inner frame of the embroidery frame is connected to the embroidery module. The secondary connecting means or secondary connector is disposed so as to be radially outside the inner frame and connected to the inner frame by a bridge. When the outer frame is connected to the inner frame, the secondary connecting means is also disposed so as to be radially outside the outer frame. The bridge accordingly bridges the outer frame which in the case of a clamped tubular or pouch-type planar formation bears on the inner surface of the latter. Since the bridge is disposed above the planar formation, or on the outside of the planar formation, respectively, the planar formation does not have to have an opening for connecting the embroidery frame to the primary connecting means or primary connector of the embroidery module. A storage space between the outer frame and the secondary connecting means, in which a portion of a clamped planar formation that protrudes beyond the embroidery frame can be received, can be achieved by a suitable design of the bridge, such as by a sufficiently large bridge length, for example, and/or by a curvature which is arcuate in the cross section.

Additionally, the first support of the embroidery module, on which the primary connecting means is displaceably mounted, can have a clearance which can be utilized as a storage space for receiving a portion of the planar formation that protrudes beyond the embroidery frame. The first support can in particular be configured in the manner of a frame. The frame can have, for example, a C-shaped cross section, wherein the primary connecting means is displaceable in a guided manner along a longitudinal leg disposed at the top, and wherein two leg ends disposed at the bottom are mounted so as to be displaceable on the second support.

In a manner corresponding to the planar formations to be processed, embroidery frames having different length and/or width can be connected to the embroidery module. The maximum possible width of the bridge for connecting an embroidery frame to the embroidery module is determined by the type of the embroidery frame, or by the width of the latter, respectively, in a manner substantially independent of the planar formation to be processed. Undesirable elastic deformations and vibrations when accelerating the embroidery frame can be minimized by a larger width of the bridge and/or of the connecting regions between the bridge and the inner frame and the primary connecting means of the embroidery module. The bridge can be made of plastic, for example, or a plastics-composite material with an enhanced flexural stiffness, or from metal. The bridge and the inner frame can be integrally configured, for example, or connected to one another by suitable connecting techniques such as, for example, adhesive bonding, welding or screw-fitting. In order for the flexural stiffness to be enhanced with a low dead weight, the bridge can comprise structures such as, for example, ribs, honeycombs, or meshes. The secondary connecting means is preferably designed such that the bridge, as an alternative to a conventional embroidery frame, can be fastened to a corresponding primary embroidery frame adapter, or primary connecting means of an embroidery module, respectively.

The secondary connecting means can be fixedly configured on the bridge, or be connected to the bridge. Alternatively, the bridge can comprise a fastening region for replaceably fastening different secondary connecting means. This enables bridges or inner frames with bridges to be configured according to the requirements of different embroidery modules.

BRIEF DESCRIPTION OF THE DRAWINGS

The invention will be explained in more detail hereunder in connection with a few figures in which.

DETAILED DESCRIPTION

Figure 1:
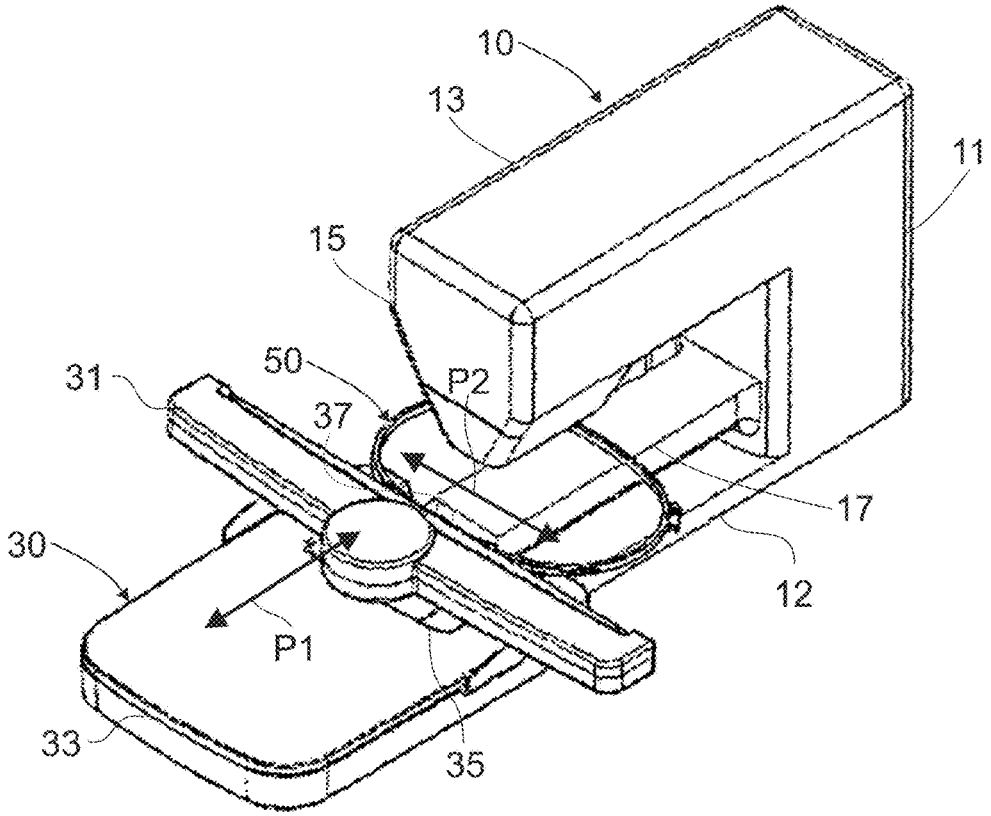
PRIOR ART FIG. 1
FIG. 1 shows a conventional embroidery system.

FIG. 1 shows a conventional embroidery system comprising a free arm sewing machine, henceforth also referred to as a sewing machine 10 for short, an embroidery module 30 which at the end side is connected to said sewing machine 10, and an embroidery frame 50 which can be repositioned by the embroidery module 30 in two directions of a sewing plane.

The sewing machine 10 comprises a base plate 12 which serves as a platform, and a stand 11 from which an upper arm 13 having a machine head 15, and therebelow a lower arm 17, laterally protrude. The upper side of the lower arm 17, or a needle plate disposed at the free end of said lower arm 17, respectively, define the sewing plane.

The embroidery module 30 comprises a first support 31 which is mounted on a second support 33 so as to be displaceable by a drive in a first displacement direction P1. When the second support 33 at the end side is docked to the sewing machine 10 or is connected to the latter, respectively, as is illustrated in FIG. 1, the displacement direction P1 corresponds to the longitudinal direction of the lower arm 17. A void between the second support 33, which is connected to the sewing machine 10, and the free end of the lower arm 17 is configured by a recess 35 on the second support 33. This void enables a tubular planar formation to be pushed over the lower arm 17 even when the second support 33 is connected to the sewing machine 10. The first support 31 is an elongate beam on which a primary embroidery frame adapter, or generally speaking a primary connector 37, respectively, is mounted so as to be displaceable by a further driving means in a second displacement direction P2, orthogonal to the first displacement direction P1.

Figure 2:
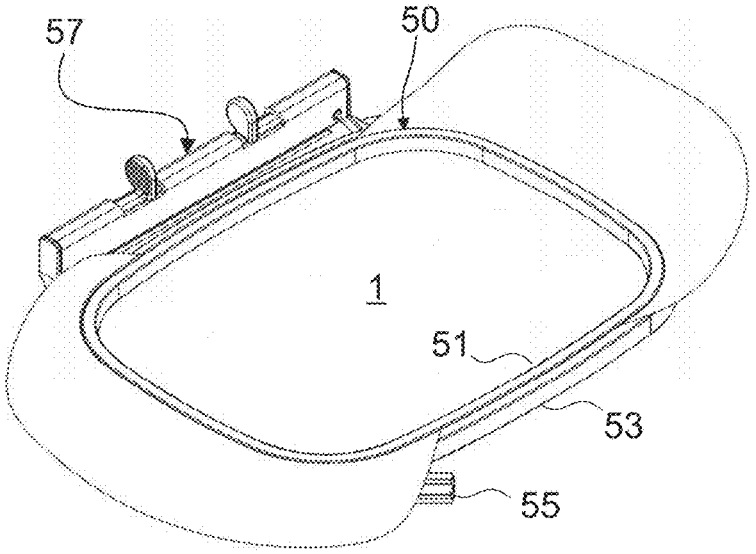
PRIOR ART FIG. 2
FIG. 2 shows a conventional embroidery frame having a clamped planar formation.

FIG. 2 shows a conventional embroidery frame 50 having an inner first frame 51 and an outer second frame 53, a planar formation 1 being held tensioned therebetween. The second frame 53 comprises a tensioning screw 55 for increasing and decreasing the circumference of the frame. The second frame 53 can be pressed against the first frame 51 lying on the inside by tightening the tensioning screw 55. The planar formation 1 here is fixedly clamped between the first frame 51 and the second frame 53. A secondary connector 57 which is releasably connectable to the primary connector 37 extends along a portion of the second frame 53 so as to be directly adjacent to the second frame 53. Tubular planar formations 1 can be processed only to a limited extent with such embroidery systems. At tubular opening 3 (FIG. 3) on that side facing the secondary connector 57 has to be at least so large that the respective end of the tube is able to receive the portion having the secondary connector 57. Only portions of the planar formation 1 that are disposed close to one of the ends of the tube can be clamped in the embroidery frame 50. There is hardly any storage space adjacent to the secondary connector 57 for receiving an end portion of the planar formation 1 that protrudes beyond the embroidery frame 50 when the embroidery frame 50 is coupled to the embroidery module 30. Tubular planar formations 1 in which one end is closed in the manner of a pouch, such as caps, for example, cannot be processed by such embroidery systems.

Figure 3:
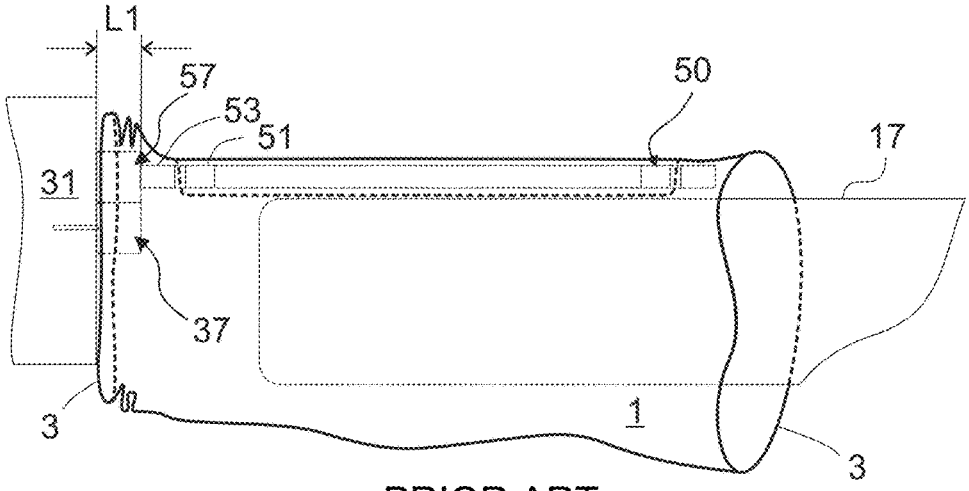
PRIOR ART FIG. 3
FIG. 3 shows a lateral detailed view of a conventional embroidery system when processing a tubular planar formation.

FIG. 3 in an exemplary manner shows a fragment of a conventional embroidery system in the region of the free end of the lower arm 17. A portion of a tubular planar formation 1, for example of a sleeve, is clamped in the embroidery frame 50. The first frame 51 lying on the inside bears on the external side of the planar formation 1, while the second frame 53 lying on the outside bears on the internal side of said planar formation 1. The sleeve is partially pushed over the lower arm 17 such that the lower side of the first frame 51 holds the clamped portion of the planar formation 1 in the sewing plane defined by the upper side of the lower arm 17. The secondary connector 57 is disposed directly on the outside on the second frame 53 and is latched to the corresponding primary connector 37, the latter being displaceably mounted on the first support 31 of the embroidery module 30. In the case of the primary and secondary connectors 37, 57, only a narrow storage space having a width L1 of, for example, one to two centimeters is available between the outer frame 53 and the first support 31 for pushing over the end region of the sleeve there.

Figure 4:
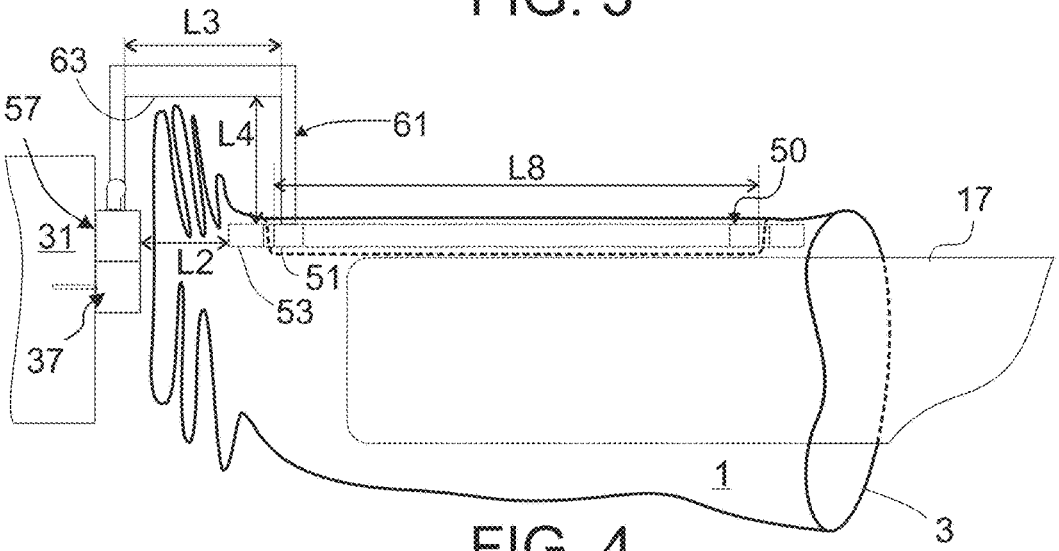
FIG. 4 shows a lateral detailed view of an embroidery system when processing a pouch-type planar formation.

In a manner analogous to that of FIG. 3, FIG. 4 shows a fragment of an embroidery system according to the invention in the region of the free end of the lower arm 17. A portion of a tubular or pouch-type planar formation 1, for example of a cover, is clamped in the embroidery frame 50. The first frame 51 lying on the inside bears on the external side of the planar formation 1, while the second frame 53 bears on the internal side of said planar formation 1. The cover is partially pushed over the lower arm 17 such that the lower side of the first frame 51 holds the clamped portion of the planar formation 1 in the sewing plane defined by the upper side of the lower arm 17. The secondary connector 57 is disposed outside the first frame 51, so as to be radially spaced apart from the latter, and by a bridge 61 is rigidly connected to this first frame 51. The bridge 61 comprises at least one connecting portion 63 which connects the first frame 51 to the secondary connector 57 and bridges the second frame 53 and optionally a portion of a clamped planar formation 1 that protrudes beyond the second frame 53 when the second frame 53 is connected to the first frame 51. The spacing L4 between the connecting portion 63 and the second frame 53 in this instance is at least as large as the maximum thickness of a planar formation 1 to be clamped. The minimum value of this spacing L4 can be in the range of, for example, approximately 1 mm to approximately 5 mm, and be, for example, approximately 2 mm or approximately 3 mm. The spacing L4, or the height of the void below the connecting portion 63, respectively, preferably is in the magnitude of approximately 1 cm to approximately 10 cm, for example approximately 3 cm to approximately 5 cm.

In the embodiment illustrated in FIG. 4, the bridge 61 is configured in the manner of a tunnel having a substantially rectangular cross-sectional shape. The height of the void between the first frame 51 and the secondary connector 57 along the entire length L3 of the connecting portion 63 corresponds substantially to the spacing L4.

In alternative embodiments, the bridge 61 can comprise one connection portion or a plurality of connection portion 63, for example. The connection portions 63 can delimit a void which is rectangular in cross section, as is illustrated in FIG. 4, for example, or comprise arcuate curvatures of identical or dissimilar heights.

The bridge 61 preferably delimits the void lying therebelow at a level which lies approximately 1 cm to approximately 5 cm above the upper level of the first frame 51. The upper delimitation of the void may however also be disposed at a higher level. The void can be utilized as a storage space for receiving a portion of the planar formation 1 that protrudes beyond the embroidery frame 50. The void which can be utilized as a storage space below and next to the first frame 51 is delimited by the first support 31 and the second support 33. The utilizable storage space can be enlarged by configuring the supports 31, 33 in a corresponding manner. In particular, the first support 31 can be configured in the manner of a bridge, whereby a crossbeam with a guide for the primary connector 37 is disposed above the second support 33 so as to be spaced apart by two lateral stanchions which are mounted so as to be displaceable on the second support 33. The storage space for the planar formation 1 to be processed is increased as a result of the void below the crossbeam. Additionally or alternatively, the second support 33 can comprise a recess 35 as is illustrated in FIG. 1.

The bridge 61 can comprise structures in the manner of ribs in order to increase the stability, in particular the flexural stiffness. Regions between such ribs can be configured so as to be free of material or only having comparatively thin material layers. Such bridges 61 have a comparatively small mass but nevertheless are very stiff and dimensionally stable. Forces of inertia acting on the bridge 61 and elastic deformations of the bridge 61 caused by the former can be restricted to a minimum even at high accelerations or rapid changes to the position of the primary connector 37. The penetration points of the sewing needle in the planar formation 1 can therefore be precisely positioned even at a high embroidering rate. The bridge 61 can be made of, for example, plastic, metal, or of a light, dimensionally stable composite material. Bridges 61 of metal can in particular be made by forming a metal sheet or a mesh, for example. Bridges 61 can be integrally configured, for example as a portion of the secondary connector 57 and/or of the first frame 51. Production and storage costs can be kept low as a result of the small number of parts required.

Figure 5:
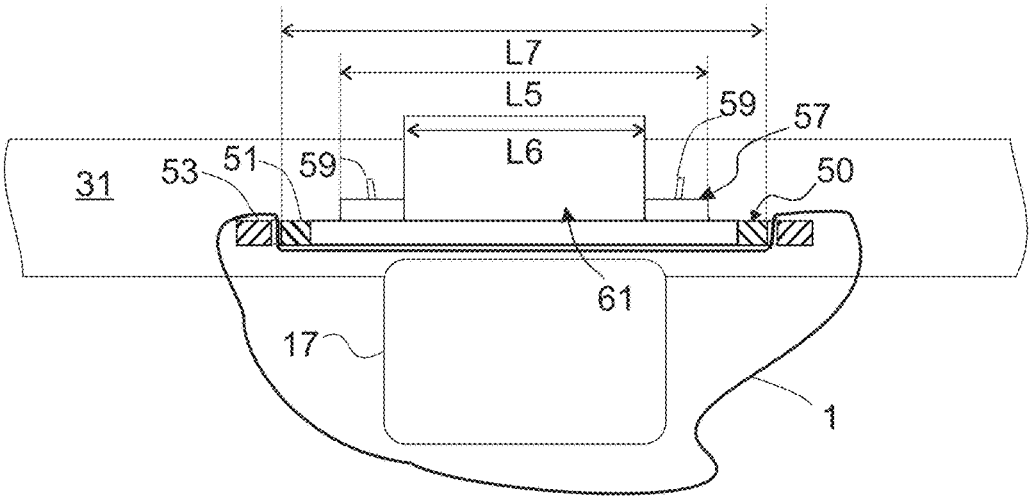
FIG. 5 shows a detailed cross section of an embroidery system with a view in the direction of the connection to an embroidery module

FIG. 5 schematically shows a cross section of an embroidery system in the region of the embroidery frame 50, viewed in the direction of the bridge 61 which connects the inner first frame 51 to the secondary connector 57. The secondary connector 57 is configured in the manner of a beam and comprises spring-loaded latching elements which by in each case one handle 59 can be moved, counter to the spring force, from a locking position to a releasing position. When the embroidery frame 50 is connected to the embroidery module 30, the latching elements in the locking position thereof are latched in a form-fitting manner to corresponding structures on the primary connector 37. In order for the embroidery frame 50 to be decoupled from the embroidery module 30, the latching elements are moved, counter to the spring force, to the releasing position by exerting a compressive force on the handles 59. The primary and secondary connectors 37, 57 for releasably coupling the embroidery frame 50 to the embroidery module 30 could also be configured in any other suitable manner.

The width L6 of the bridge 61 is smaller than or equal to the length L5 of the beam-shaped secondary connector 57. This length L5 in turn is typically smaller than or equal to the length L7 of the first frame 51 in this direction. The secondary connector 57, at least in portions along the entire length L5 thereof, preferably bears on the primary connector 37 when the former is connected to the latter. The stability of the connection is improved as the length L5 increases, and torques acting on the secondary connector 57 when the primary connector 37 is being accelerated are smaller. Embroidery frames 50 can be optimized for specific applications. Embroidery frames 50 for embroidering tubular material with a comparatively small circumference such as, for example, sleeves preferably have first frames 51, the length L7 thereof in the transverse direction of the lower arm 17 being in the magnitude of the width of the lower arm 17 and being, for example, approximately 6 cm to approximately 10 cm. The length L8 of the first frame 51 can be larger than, equal to or smaller than the length L7 of said first frame 51.

The maximum dimensions of the first frame 51 in the transverse direction, or in the longitudinal direction, respectively, of the bridge 61 are in each case referred to as lengths L7 and L8, respectively, independently of the shape of said bridge 61 which can be configured so as to be rectangular, square, elliptical, oval, circular or in any other manner, for example.

In further embodiments, the bridge 61 proximal to the embroidery frame and/or on the side of the secondary connector 57 can comprise in each case one adapter 65 by way of which the bridge 61 can be permanently or releasably fastened to the inner frame 51 of an embroidery frame 50 and/or to the secondary connector 57.

Figure 6:
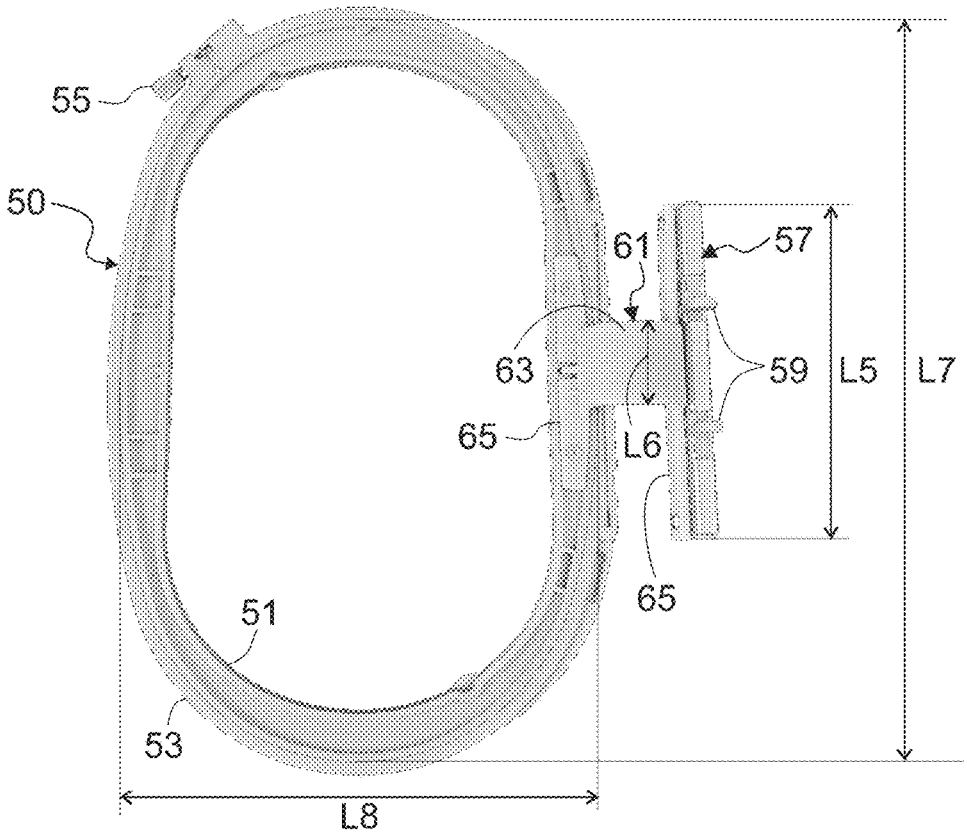
FIG. 6 shows an embroidery frame assembly in an overall view.

FIG. 6 in an exemplary manner shows an embroidery frame 50 in which the connecting portion 63 of the bridge 61 is configured so as to be arcuate. One fastening arm of the respective adapter 65 protrudes on both sides of the bridge 61 at each of the two end regions. These fastening arms are fixedly screwed to the upper side of the first frame 51 by screws. This connection can be released by a tool if required. In general, connections between an adapter 65 and an adjacent part, such as the secondary connector 57 or the inner frame 51, can be configured so as to be fixed or releasable. Possible connection techniques are, for example, screw-fitting, welding, adhesive bonding, latching of latching elements, or fixedly clamping using tensioning elements, for example.

Figure 7:
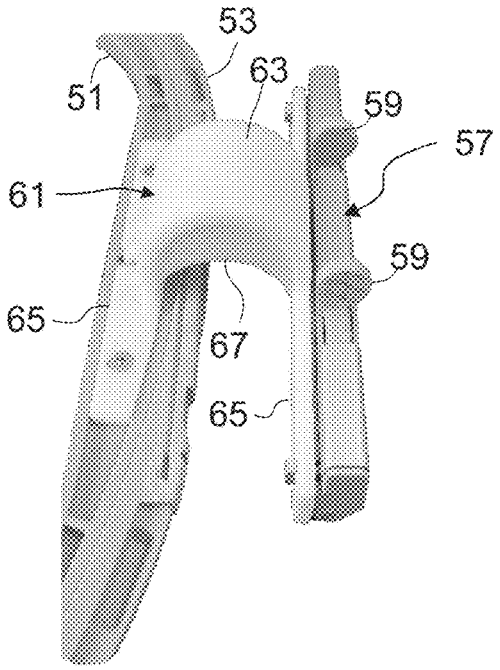
FIG. 7 shows a detail of the embroidery frame assembly from FIG. 6 in the region of a bridge.

FIG. 7 shows details of the assembly from FIG. 6 in the region of the bridge 61, in a lateral perspective view. The connecting portion 63 on the lower side thereof comprises a plurality of reinforcement ribs 67 of which the frontmost is visible in FIG. 6.

In further embodiments of bridges 61, the width L6 of the connecting portion 63 can also be larger and correspond to approximately the width L5 of a secondary connector 57, for example. This has the effect of improving the torsional stiffness. In such bridges 61, adapters 65 can comprise contact regions for fastening to secondary connector 57 and to the inner frame 51, said contact regions being configured differently from fastening arms.

Figure 8:
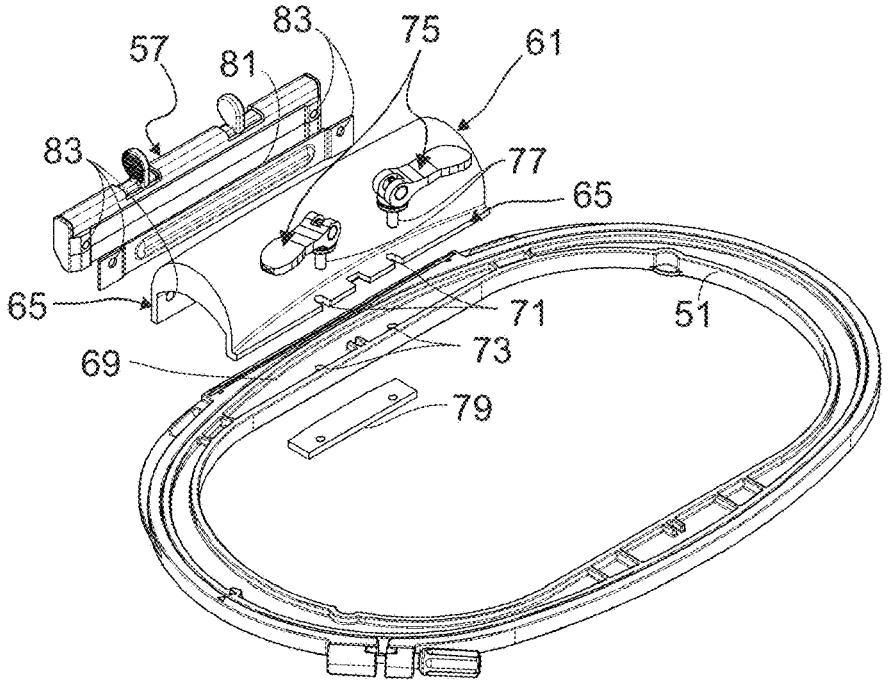
FIG. 8 shows an exploded illustration of a further embroidery frame assembly.
Figure 9:
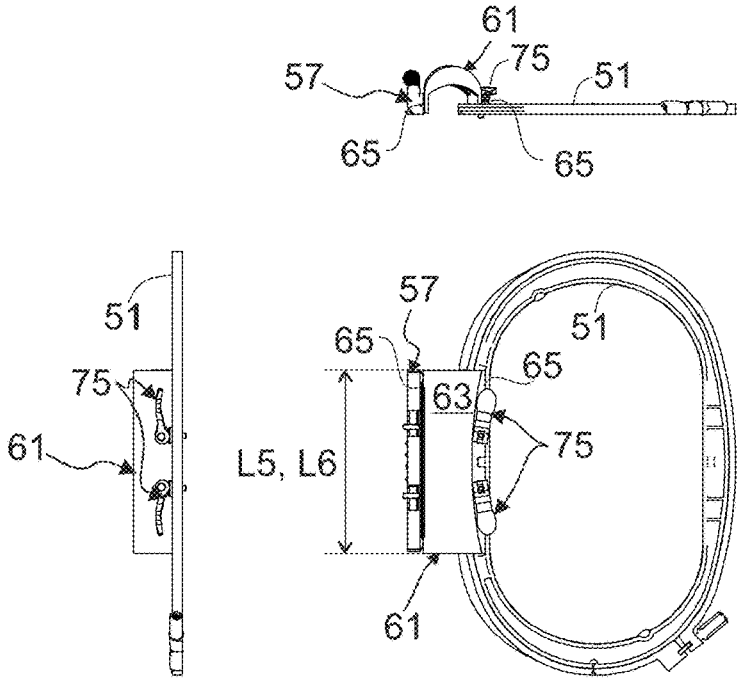
FIG. 9 shows three views of the base of the embroidery frame assembly illustrated in FIG. 8.

An example of such an embroidery frame assembly is shown in an exploded illustration in FIG. 8 and in three views of the base in FIG. 9. The embroidery frame-proximal adapter 65 as a contact region comprises a contact plate, the shape thereof being adapted to that of a corresponding depression 69 on the upper side of the inner frame 51. This facilitates the joining of these parts in a defined mutual position, wherein the positions of recesses 71 in the contact plate and of bores 73 on the inner frame 51 are identical. The fastening of the bridge 61 preferably takes place in a releasable manner, for example by two quick-release elements 75. Each of these quick-release elements 75 comprises a pin 77 which is in each case guided through one of the recesses 71 and the bores 73 and fastened to a plate 79 held at the bottom of the inner frame 51. The bridge 61 can be releasably clamped to the inner frame 51, or connected to the latter, respectively, by toggling pivotable tensioning levers of the tensioning elements 75.

The second adapter 65 on the opposite side of the bridge 61 comprises a bearing face for fastening the secondary connector 57. If required, an intermediate plate 81 which serves as a spacer, for example, can be disposed between the bearing face and the secondary connector 57. The fastening can take place by screws, for example (not illustrated), whereby the parts to be connected have corresponding screw holes 83. The secondary connector 57 in conjunction with such bridges 61 can be connected to different inner frames 51 in a simple and releasable manner.

Alternatively or additionally, the secondary connector 57 in further embodiments could be connected to the bridge 61 by a quick-release connection which is easy to release (not illustrated).

The embroidery frame assembly in its entirety or parts thereof, such as the secondary connector 57, the bridge 61 or the inner frame 51, can be unambiguously identified by a code. This code is preferably an identification code by way of which the respective embroidery frame assembly or the respective part can be unambiguously identified.

This code is configured such that said code can be detected, for example mechanically optically or electromagnetically, by a corresponding sensor installation. For this purpose, the sensor installation comprises at least one sensor element, for example a feeler device, a camera, a pressure sensor, or a capacitive or inductive sensor (not illustrated). The code is preferably disposed at the secondary connector 57 or at the bridge 61, thus close to the connecting point to the primary connector 37 of the embroidery module 30. Such codes can be easily detected by a sensor installation disposed on the embroidery module 30, for example. Alternatively, the sensor installation or parts thereof, such as evaluation electronics for processing sensor signals, for example, can also be disposed on the sewing machine 10, for example as part of the sewing machine controller. Reference variables corresponding to each code are stored in the sewing machine controller. When an embroidery frame assembly is connected to the embroidery module, the sewing machine controller identifies this embroidery frame assembly, or part of this embroidery frame assembly, by the respective code detected. The sewing machine controller comprises a memory in which further items of information associated with each code which are relevant for controlling the sewing machine and the embroidery module in conjunction with the respective embroidery frame assembly are stored. Such stored items of information can comprise reference values, for example, which define the position of a predefined reference point of the embroidery frame assembly relative to a predefined reference point of the sewing machine 10 when the embroidery frame 50 is connected to the embroidery module 30 and the embroidery module 30 is connected to the sewing machine 10. In analogous manner, characteristics which define the range of area available for embroidering within the embroidering frame 50 may be stored, for example.

If a bridge 61 is configured for replaceably fastening inner frames 50 of different sizes, the sewing machine controller by a code disposed on this bridge 61 identifies that the connected embroidery frame assembly is not yet unambiguously characterized. Details still missing can be established by an operator by way of a user interface with input means, for example. The sewing machine controller here can comprise stored data of a plurality of embroidery frames, for example, and request the operator to select one of these embroidery frames.

The invention claimed is:

1. An embroidery system, comprising:

a sewing machine (10) having a lower arm (17) which protrudes laterally from a machine stand (11), an upper side of said lower arm (17) defining a sewing plane;

an embroidery module (30) and an embroidery frame (50), the embroidery module (30) comprises:

a first support (31) on which a primary connector (37) is mounted so as to be movable in a second displacement direction (P2) parallel to the sewing plane, said first support (31) is disposed opposite the machine stand (11) or laterally next to the lower arm (17) and is mounted so as to be movable in a first displacement direction (P1) parallel to the sewing plane;

the embroidery frame (50) comprises:

a first frame (51) and a second frame (53), a device for at least one of clamping or holding a portion of a planar formation (1) to be processed between the first and second frames (51, 53), the first frame (51) is adapted to be disposed on an upper side and the second frame (53) is adapted to be disposed on a lower side of the planar formation (1), a secondary connector (57), which is releasably connectable to the primary connector (37) of the embroidery module (30), disposed outside the first frame (51), so as to be radially spaced apart from the first frame, and is rigidly connected to the first frame (51) by a bridge (61), wherein the bridge (61) comprises at least one connecting portion (63) which connects the first frame (51) to the secondary connector (57) and bridges the second frame (53) when the second frame is connected to the first frame (51), and wherein a spacing (L4), or a height of a void defined between the connecting portion (63) and the second frame (53) is from 1 centimeter to 10 centimeters.

2. The embroidery system as claimed in claim 1, wherein the bridge (61) is configured as a tunnel, and the connecting portion (63) upwardly delimits the void laterally between the first frame (51) and the secondary connector (57).

3. The embroidery system as claimed in claim 1, wherein the bridge (61) comprises three-dimensional structures for increasing stability.

4. The embroidery system as claimed in claim 1, wherein the bridge (61) is made at least one of plastic, a composite material, or from metal.

5. The embroidery system as claimed in claim 1, wherein at least one of the bridge (61) and the first frame (51) or the bridge (61) and the secondary connector (57) are integrally configured.

6. The embroidery system as claimed in claim 1, wherein the bridge (61) comprises at least one adapter (65) which is permanently or releasably connectable to at least one of the first frame (51) or the secondary connector (57).

7. The embroidery system as claimed in claim 6, wherein each said adapter (65) is disposed on an end region of the connecting portion (63) and on both sides of the bridge (61) and comprises protruding fastening arms.

8. The embroidery system as claimed in claim 1, wherein an embroidery frame assembly comprising the secondary connector (57), the bridge (61) and the embroidery frame (50) has a coding with a code which unambiguously identifies said embroidery frame assembly.

9. The embroidery system as claimed in claim 1, wherein the bridge (61) and the at least one connecting portion (63) are free from contact with the second frame (53) when the second frame is connected to the first frame (51).

10. An embroidery frame assembly of an embroidery system, the embroidery frame assembly comprising;

an embroidery frame (50) having a first frame (51) and a second frame (53) and a device for at least one of clamping or holding a portion of a planar formation (1) to be processed between the first and second frames (51, 53), the first frame (51) is adapted to be disposed on an upper side and the second frame (53) is adapted to be disposed on a lower side of the planar formation (1), a secondary connector (57) which is configured to be releasably connectable to a primary connector (37) of an embroidery module (30) disposed outside the first frame (51), so as to be radially spaced apart from the first frame, and is rigidly connected in a permanent or releasable manner to the first frame (51) by a bridge (61), wherein the bridge (61) comprises at least one connecting portion (63) which connects the first frame (51) to the secondary connector (57) and bridges the second frame (53) when the second frame is connected to the first frame (51), such that the bridge (61) and the at least one connecting portion (63) are free from contact with the second frame (53), and wherein a spacing (L4), or a height of a void defined between the connecting portion (63) and the second frame (53) is from 1 centimeter to 10 centimeters.

11. The embroidery frame assembly of claim 10, wherein the height of the void is defined vertically between the connecting portion (63) and the second frame (53).

12. The embroidery frame assembly of claim 10, wherein the bridge (61) is configured as a tunnel, and the connecting portion (63) upwardly delimits the void laterally between the first frame (51) and the secondary connector (57).

13. The embroidery frame assembly of claim 10, wherein the bridge (61) comprises at least one adapter (65) which is permanently connectable to the first frame (51).

14. The embroidery frame assembly of claim 13, wherein the at least one adapter (65) of the bridge (61) is releasably connectable to the secondary connector (57).

* * * * *